US010186786B2

(12) United States Patent
Hinman et al.

(10) Patent No.: US 10,186,786 B2
(45) Date of Patent: Jan. 22, 2019

(54) ENCLOSURE FOR RADIO, PARABOLIC DISH ANTENNA, AND SIDE LOBE SHIELDS

(71) Applicant: Mimosa Networks, Inc., Santa Clara, CA (US)

(72) Inventors: Brian L. Hinman, Los Gatos, CA (US); Wayne Miller, Los Altos, CA (US); Carlos Ramos, San Jose, CA (US)

(73) Assignee: Mimosa Networks, Inc., Santa Clara, CA (US)

( * ) Notice: Subject to any disclaimer, the term of this patent is extended or adjusted under 35 U.S.C. 154(b) by 0 days.

(21) Appl. No.: 15/809,942

(22) Filed: Nov. 10, 2017

(65) Prior Publication Data

US 2018/0083365 A1 Mar. 22, 2018

Related U.S. Application Data

(63) Continuation of application No. 15/139,225, filed on Apr. 26, 2016, now Pat. No. 9,871,302, which is a continuation of application No. 14/198,378, filed on Mar. 5, 2014, now Pat. No. 9,362,629.

(60) Provisional application No. 61/773,757, filed on Mar. 6, 2013.

(51) Int. Cl.

| | |
|---|---|
| ***H01Q 19/13*** | (2006.01) |
| ***H01Q 21/00*** | (2006.01) |
| ***H01Q 1/52*** | (2006.01) |
| ***H01Q 1/42*** | (2006.01) |
| ***H01Q 19/19*** | (2006.01) |

(52) U.S. Cl.
CPC ..... *H01Q 19/13* (2013.01); *H01Q 1/42* (2013.01); *H01Q 1/526* (2013.01); *H01Q 19/19* (2013.01); *H01Q 19/191* (2013.01); *H01Q 21/00* (2013.01)

(58) Field of Classification Search
None
See application file for complete search history.

(56) References Cited

U.S. PATENT DOCUMENTS

| | | | |
|---|---|---|---|
| 2,735,993 | A | 2/1956 | Humphrey |
| 3,182,129 | A | 5/1965 | Clark et al. |
| D227,476 | S | 6/1973 | Kennedy |
| 4,188,633 | A | 2/1980 | Frazita |

(Continued)

FOREIGN PATENT DOCUMENTS

| | | | |
|---|---|---|---|
| CN | 104335654 | A | 2/2015 |
| CN | 303453662 | S | 11/2015 |

(Continued)

OTHER PUBLICATIONS

"Office Action," Chinese Patent Application No. 201580000078.6, dated Nov. 3, 2017, 5 pages [10 pages including translation].

(Continued)

*Primary Examiner* — Howard Williams
(74) *Attorney, Agent, or Firm* — Carr & Ferrell LLP

(57) ABSTRACT

Enclosures for radios, parabolic dish antennas, and side lobe shields are provided herein. A dish antenna includes a parabolic circular reflector bounded by a side lobe shield that extends along a longitudinal axis of the dish antenna in a forward direction forming a front cavity, and a sidewall that extends along the longitudinal axis of the dish antenna in a rearward direction forming a rear cavity.

16 Claims, 4 Drawing Sheets

(56) References Cited

U.S. PATENT DOCUMENTS 4,402,566 A 9/1983 Powell et al.
D273,111 S 3/1984 Hirata et al.
4,543,579 A 9/1985 Teshirogi
4,562,416 A 12/1985 Sedivec
4,626,863 A * 12/1986 Knop ..... H01Q 19/19 343/781 P
4,835,538 A 5/1989 McKenna et al.
4,866,451 A 9/1989 Chen
4,893,288 A 1/1990 Maier et al.
4,903,033 A 2/1990 Tsao et al.
4,986,764 A 1/1991 Eaby et al.
5,015,195 A 5/1991 Piriz
5,226,837 A 7/1993 Cinibulk et al.
5,231,406 A 7/1993 Sreenivas
D346,598 S 5/1994 McCay et al.
D355,416 S 2/1995 McCay et al.
5,389,941 A 2/1995 Yu
5,491,833 A 2/1996 Hamabe
5,513,380 A 4/1996 Ivanov et al.
5,561,434 A 10/1996 Yamazaki
D375,501 S 11/1996 Lee et al.
5,580,264 A 12/1996 Aoyama et al.
5,684,495 A 11/1997 Dyott et al.
D389,575 S 1/1998 Grastield et al.
5,724,666 A 3/1998 Dent
5,742,911 A 4/1998 Dumbrill et al.
5,746,611 A 5/1998 Brown et al.
6,014,372 A 1/2000 Kent et al.
6,067,053 A 5/2000 Runyon et al.
6,137,449 A 10/2000 Kildal
6,140,962 A 10/2000 Groenenboom
6,176,739 B1 1/2001 Denlinger et al.
6,216,266 B1 4/2001 Eastman et al.
6,304,762 B1 10/2001 Myers et al.
D455,735 S 4/2002 Winslow
6,421,538 B1 7/2002 Byrne
6,716,063 B1 4/2004 Bryant et al.
6,754,511 B1 6/2004 Halford et al.
6,847,653 B1 1/2005 Smiroldo
D501,848 S 2/2005 Uehara et al.
6,877,277 B2 4/2005 Kussel et al.
6,962,445 B2 11/2005 Zimmel et al.
7,075,492 B1 7/2006 Chen et al.
D533,899 S 12/2006 Ohashi et al.
7,173,570 B1 2/2007 Wensink et al.
7,187,328 B2 3/2007 Tanaka et al.
7,193,562 B2 3/2007 Shtrom et al.
7,212,163 B2 5/2007 Huang et al.
7,245,265 B2 7/2007 Kienzle et al.
7,253,783 B2 8/2007 Chiang et al.
7,264,494 B2 9/2007 Kennedy et al.
7,281,856 B2 10/2007 Grzegorzewska et al.
7,292,198 B2 11/2007 Shtrom et al.
7,306,485 B2 12/2007 Masuzaki
7,324,057 B2 1/2008 Argaman et al.
D566,698 S 4/2008 Choi et al.
7,362,236 B2 4/2008 Hoiness
7,369,095 B2 5/2008 Hirtzlin et al.
7,380,984 B2 6/2008 Wuester
7,431,602 B2 10/2008 Corona
7,498,996 B2 3/2009 Shtrom et al.
7,507,105 B1 3/2009 Peters et al.
7,542,717 B2 6/2009 Green, Sr. et al.
7,581,976 B2 9/2009 Liepold et al.
7,586,891 B1 9/2009 Masciulli
7,616,959 B2 11/2009 Spenik et al.
7,675,473 B2 3/2010 Kienzle et al.
7,726,997 B2 6/2010 Kennedy et al.
7,778,226 B2 8/2010 Rayzman et al.
7,857,523 B2 12/2010 Masuzaki
7,929,914 B2 4/2011 Tegreene
RE42,522 E 7/2011 Zimmel et al.
8,009,646 B2 8/2011 Lastinger et al.
8,069,465 B1 11/2011 Bartholomay et al.
8,111,678 B2 2/2012 Lastinger et al.
8,270,383 B2 9/2012 Lastinger et al.
8,325,695 B2 12/2012 Lastinger et al.
D674,787 S 1/2013 Tsuda et al.
8,345,651 B2 1/2013 Lastinger et al.
8,482,478 B2 7/2013 Hartenstein
8,515,434 B1 8/2013 Narendran et al.
8,515,495 B2 8/2013 Shang et al.
D694,740 S 12/2013 Apostolakis
8,777,660 B2 7/2014 Chiarelli et al.
8,792,759 B2 7/2014 Benton et al.
8,827,729 B2 9/2014 Gunreben et al.
8,836,601 B2 * 9/2014 Sanford ..... H01Q 19/12 343/837
8,870,069 B2 10/2014 Bellows
8,935,122 B2 1/2015 Stisser
9,001,689 B1 4/2015 Hinman et al.
9,019,874 B2 4/2015 Choudhury et al.
9,077,071 B2 7/2015 Shtrom et al.
9,107,134 B1 8/2015 Belser et al.
9,130,305 B2 9/2015 Ramos et al.
9,161,387 B2 10/2015 Fink et al.
9,179,336 B2 11/2015 Fink et al.
9,191,081 B2 11/2015 Hinman et al.
D752,566 S 3/2016 Hinman et al.
9,295,103 B2 3/2016 Fink et al.
9,362,629 B2 6/2016 Hinman et al.
9,391,375 B1 7/2016 Bales et al.
9,407,012 B2 8/2016 Shtrom et al.
9,431,702 B2 8/2016 Hartenstein
9,504,049 B2 11/2016 Hinman et al.
9,531,114 B2 12/2016 Ramos et al.
9,537,204 B2 1/2017 Cheng et al.
9,577,340 B2 2/2017 Fakharzadeh et al.
9,693,388 B2 6/2017 Fink et al.
9,780,892 B2 10/2017 Hinman et al.
9,843,940 B2 12/2017 Hinman et al.
9,871,302 B2 1/2018 Hinman et al.
9,888,485 B2 2/2018 Hinman et al.
9,930,592 B2 3/2018 Hinman
9,949,147 B2 4/2018 Hinman et al.
10,090,943 B2 10/2018 Hinman et al.
10,096,933 B2 10/2018 Ramos et al.
10,117,114 B2 10/2018 Hinman et al.
2001/0033600 A1 10/2001 Yang et al.
2002/0102948 A1 8/2002 Stanwood et al.
2002/0159434 A1 10/2002 Gosior et al.
2003/0013452 A1 1/2003 Hunt et al.
2003/0027577 A1 2/2003 Brown et al.
2003/0169763 A1 9/2003 Choi
2003/0222831 A1 12/2003 Dunlap
2003/0224741 A1 12/2003 Sugar et al.
2004/0002357 A1 1/2004 Benveniste
2004/0029549 A1 2/2004 Fikart
2004/0110469 A1 6/2004 Judd et al.
2004/0120277 A1 6/2004 Holur et al.
2004/0196812 A1 10/2004 Barber
2004/0196813 A1 10/2004 Ofek et al.
2004/0240376 A1 12/2004 Wang et al.
2004/0242274 A1 12/2004 Corbett et al.
2005/0032479 A1 2/2005 Miller et al.
2005/0058111 A1 3/2005 Hung et al.
2005/0124294 A1 6/2005 Wentink
2005/0143014 A1 6/2005 Li et al.
2005/0195758 A1 9/2005 Chitrapu
2005/0227625 A1 10/2005 Diener
2005/0254442 A1 11/2005 Proctor, Jr. et al.
2005/0271056 A1 12/2005 Kaneko
2005/0275527 A1 12/2005 Kates
2006/0025072 A1 2/2006 Pan
2006/0072518 A1 4/2006 Pan et al.
2006/0098592 A1 5/2006 Proctor, Jr. et al.
2006/0099940 A1 5/2006 Pfleging et al.
2006/0132359 A1 6/2006 Chang et al.
2006/0132602 A1 6/2006 Muto et al.
2006/0172578 A1 8/2006 Parsons
2006/0187952 A1 8/2006 Kappes et al.
2006/0211430 A1 9/2006 Persico
2007/0001910 A1 1/2007 Yamanaka et al.
2007/0019664 A1 1/2007 Benveniste

(56) References Cited

U.S. PATENT DOCUMENTS

2007/0035463 A1 2/2007 Hirabayashi
2007/0060158 A1 3/2007 Medepalli et al.
2007/0132643 A1 6/2007 Durham et al.
2007/0173199 A1 7/2007 Sinha
2007/0173260 A1 7/2007 Love et al.
2007/0210974 A1 9/2007 Chiang
2007/0223701 A1 9/2007 Emeott et al.
2007/0238482 A1 10/2007 Rayzman et al.
2007/0255797 A1 11/2007 Dunn et al.
2007/0268848 A1 11/2007 Khandekar et al.
2008/0109051 A1 5/2008 Splinter et al.
2008/0112380 A1 5/2008 Fischer
2008/0192707 A1 8/2008 Xhafa et al.
2008/0218418 A1 9/2008 Gillette
2008/0231541 A1 9/2008 Teshirogi et al.
2008/0242342 A1 10/2008 Rofougaran
2009/0046673 A1 2/2009 Kaidar
2009/0052362 A1 2/2009 Meier et al.
2009/0075606 A1 3/2009 Shtrom et al.
2009/0232026 A1 9/2009 Lu
2009/0233475 A1 9/2009 Mildon et al.
2009/0291690 A1 11/2009 Guvenc et al.
2009/0315792 A1 12/2009 Miyashita et al.
2010/0029282 A1 2/2010 Stamoulis et al.
2010/0039340 A1 2/2010 Brown
2010/0046650 A1 2/2010 Jongren et al.
2010/0067505 A1 3/2010 Fein et al.
2010/0085950 A1 4/2010 Sekiya
2010/0091818 A1 4/2010 Sen et al.
2010/0103065 A1 4/2010 Shtrom et al.
2010/0103066 A1 4/2010 Shtrom et al.
2010/0136978 A1 6/2010 Cho et al.
2010/0151877 A1 6/2010 Lee et al.
2010/0167719 A1 7/2010 Sun
2010/0171665 A1 7/2010 Nogami
2010/0171675 A1 7/2010 Borja et al.
2010/0189005 A1 7/2010 Bertani et al.
2010/0202613 A1 8/2010 Ray et al.
2010/0210147 A1 8/2010 Hauser
2010/0216412 A1 8/2010 Rofougaran
2010/0238083 A1 9/2010 Malasani
2010/0315307 A1* 12/2010 Syed ..... H01Q 19/134 343/841
2010/0322219 A1 12/2010 Fischer et al.
2011/0006956 A1* 1/2011 McCown ..... H01Q 19/13 343/702
2011/0028097 A1 2/2011 Memik et al.
2011/0032159 A1 2/2011 Wu et al.
2011/0044186 A1 2/2011 Jung et al.
2011/0103309 A1 5/2011 Wang et al.
2011/0111715 A1 5/2011 Buer et al.
2011/0133996 A1 6/2011 Alapuranen
2011/0170424 A1 7/2011 Safavi
2011/0172916 A1 7/2011 Pakzad et al.
2011/0182260 A1 7/2011 Sivakumar et al.
2011/0182277 A1 7/2011 Shapira
2011/0194644 A1 8/2011 Liu et al.
2011/0206012 A1 8/2011 Youn et al.
2011/0241969 A1 10/2011 Zhang et al.
2011/0243291 A1 10/2011 McAllister et al.
2011/0256874 A1 10/2011 Hayama et al.
2011/0291914 A1* 12/2011 Lewry ..... H01Q 15/166 343/912
2012/0008542 A1 1/2012 Koleszar et al.
2012/0040700 A1 2/2012 Gomes et al.
2012/0057533 A1 3/2012 Junell et al.
2012/0093091 A1 4/2012 Kang et al.
2012/0115487 A1 5/2012 Josso
2012/0134280 A1 5/2012 Rotvold et al.
2012/0140651 A1 6/2012 Nicoara et al.
2012/0238201 A1 9/2012 Du et al.
2012/0263145 A1 10/2012 Marinier et al.
2012/0282868 A1 11/2012 Hahn
2012/0299789 A1 11/2012 Orban et al.
2012/0314634 A1 12/2012 Sekhar
2013/0003645 A1 1/2013 Shapira et al.
2013/0005350 A1 1/2013 Campos et al.
2013/0023216 A1 1/2013 Moscibroda et al.
2013/0064161 A1 3/2013 Hedayat et al.
2013/0082899 A1 4/2013 Gomi
2013/0095747 A1 4/2013 Moshfeghi
2013/0128858 A1 5/2013 Zou et al.
2013/0176902 A1 7/2013 Wentink et al.
2013/0182652 A1 7/2013 Tong et al.
2013/0195081 A1 8/2013 Merlin et al.
2013/0210457 A1 8/2013 Kummetz
2013/0223398 A1 8/2013 Li et al.
2013/0271319 A1 10/2013 Trerise
2013/0286950 A1 10/2013 Pu
2013/0286959 A1 10/2013 Lou et al.
2013/0288735 A1 10/2013 Guo
2013/0301438 A1 11/2013 Li et al.
2013/0322276 A1 12/2013 Pelletier et al.
2013/0322413 A1 12/2013 Pelletier et al.
2014/0024328 A1 1/2014 Balbien et al.
2014/0051357 A1 2/2014 Steer et al.
2014/0098748 A1 4/2014 Chan et al.
2014/0145890 A1 5/2014 Ramberg et al.
2014/0185494 A1 7/2014 Yang et al.
2014/0191918 A1 7/2014 Cheng et al.
2014/0198867 A1 7/2014 Sturkovich et al.
2014/0206322 A1 7/2014 Dimou et al.
2014/0225788 A1 8/2014 Schulz et al.
2014/0233613 A1 8/2014 Fink et al.
2014/0235244 A1 8/2014 Hinman
2014/0253378 A1 9/2014 Hinman
2014/0253402 A1 9/2014 Hinman et al.
2014/0254700 A1 9/2014 Hinman et al.
2014/0256166 A1 9/2014 Ramos et al.
2014/0320306 A1 10/2014 Winter
2014/0320377 A1 10/2014 Cheng et al.
2014/0355578 A1 12/2014 Fink et al.
2014/0355584 A1 12/2014 Fink et al.
2015/0002335 A1 1/2015 Hinman et al.
2015/0002354 A1 1/2015 Knowles
2015/0015435 A1 1/2015 Shen et al.
2015/0215952 A1 7/2015 Hinman et al.
2015/0256275 A1 9/2015 Hinman et al.
2015/0263816 A1 9/2015 Hinman et al.
2015/0319584 A1 11/2015 Fink et al.
2015/0321017 A1 11/2015 Perryman et al.
2015/0325945 A1 11/2015 Ramos et al.
2015/0327272 A1 11/2015 Fink et al.
2015/0365866 A1 12/2015 Hinman et al.
2016/0119018 A1 4/2016 Lindgren et al.
2016/0149634 A1 5/2016 Kalkunte et al.
2016/0149635 A1 5/2016 Hinman et al.
2016/0211583 A1 7/2016 Lee et al.
2016/0240929 A1 8/2016 Hinman et al.
2016/0338076 A1 11/2016 Hinman et al.
2016/0365666 A1 12/2016 Ramos et al.
2016/0366601 A1 12/2016 Hinman et al.
2017/0048647 A1 2/2017 Jung et al.
2017/0201028 A1 7/2017 Eberhardt et al.
2017/0238151 A1 8/2017 Fink et al.
2017/0294975 A1 10/2017 Hinman et al.
2018/0034166 A1 2/2018 Hinman
2018/0035317 A1 2/2018 Hinman et al.
2018/0084563 A1 3/2018 Hinman et al.
2018/0192305 A1 7/2018 Hinman et al.
2018/0199345 A1 7/2018 Fink et al.
2018/0241491 A1 8/2018 Hinman et al.

FOREIGN PATENT DOCUMENTS

CN 105191204 A 12/2015
EM 002640177 2/2015
EP 1384285 B1 6/2007
WO WO2014137370 A1 9/2014
WO WO2014138292 A1 9/2014
WO WO2014193394 A1 12/2014
WO WO2015112627 A1 7/2015

(56) References Cited

FOREIGN PATENT DOCUMENTS

WO 2017123558 A1 7/2017
WO WO2018022526A1 A1 2/2018

OTHER PUBLICATIONS

"International Search Report" and "Written Opinion of the International Searching Authority," Patent Cooperation Treaty Application No. PCT/US2017/043560, dated Nov. 16, 2017, 11 pages.
Non-Final Office Action, dated Dec. 11, 2013, U.S. Appl. No. 13/906,128, filed May 30, 2013.
Non-Final Office Action, dated Dec. 24, 2013, U.S. Appl. No. 14/045,741, filed Oct. 3, 2013.
Final Office Action, dated Apr. 15, 2014, U.S. Appl. No. 13/906,128, filed May 30, 2013.
Final Office Action, dated Apr. 16, 2014, U.S. Appl. No. 14/045,741, filed Oct. 3, 2013.
Non-Final Office Action, dated Jun. 16, 2014, U.S. Appl. No. 14/164,081, filed Jan. 24, 2014.
Advisory Action, dated Jul. 31, 2014, U.S. Appl. No. 13/906,128, filed May 30, 2013.
Non-Final Office Action, dated Aug. 25, 2014, U.S. Appl. No. 13/906,128, filed May 30, 2013.
Non-Final Office Action, dated Sep. 22, 2014, U.S. Appl. No. 14/045,741, filed Oct. 3, 2013.
Notice of Allowance, dated Dec. 30, 2014, U.S. Appl. No. 14/164,081, filed Jan. 24, 2014.
Non-Final Office Action, dated Jan. 2, 2015, U.S. Appl. No. 13/925,566, filed Jun. 24, 2013.
Non-Final Office Action, dated Jan. 5, 2015, U.S. Appl. No. 14/183,445, filed Feb. 18, 2014.
Non-Final Office Action, dated Jan. 15, 2015, U.S. Appl. No. 14/183,329, filed Feb. 18, 2014.
Non-Final Office Action, dated Mar. 18, 2015, U.S. Appl. No. 14/183,375, filed Feb. 18, 2014.
Final Office Action, dated Mar. 23, 2015, U.S. Appl. No. 13/906,128, filed May 30, 2013.
Notice of Allowance, dated Jun. 3, 2015, U.S. Appl. No. 14/045,741, filed Oct. 3, 2013.
Notice of Allowance, dated Jul. 13, 2015, U.S. Appl. No. 14/183,445, filed Feb. 18, 2014.
Notice of Allowance, dated Jul. 15, 2015, U.S. Appl. No. 13/925,566, filed Jun. 24, 2013.
Notice of Allowance, dated Aug. 19, 2015, U.S. Appl. No. 14/183,329, filed Feb. 18, 2014.
Non-Final Office Action, dated Sep. 10, 2015, U.S. Appl. No. 14/198,378, filed Mar. 5, 2014.
Non-Final Office Action, dated Sep. 17, 2015, U.S. Appl. No. 14/741,423, filed Jun. 16, 2015.
Notice of Allowance, dated Oct. 26, 2015, U.S. Appl. No. 13/906,128, filed May 30, 2013.
Final Office Action, dated Nov. 24, 2015, U.S. Appl. No. 14/183,375, filed Feb. 18, 2014.
Notice of Allowance, dated Jan. 11, 2016, U.S. Appl. No. 29/502,253, filed Sep. 12, 2014.
Advisory Action, dated Mar. 2, 2016, U.S. Appl. No. 14/183,375, filed Feb. 18, 2014.
Non-Final Office Action, dated Mar. 16, 2016, U.S. Appl. No. 14/325,307, filed Jul. 7, 2014.
Notice of Allowance, dated Apr. 6, 2016, U.S. Appl. No. 14/198,378, filed Mar. 5, 2014.
Non-Final Office Action, dated Apr. 7, 2016, U.S. Appl. No. 14/639,976, filed Mar. 5, 2015.
Non-Final Office Action, dated Apr. 26, 2016, U.S. Appl. No. 14/802,829, filed Jul. 17, 2015.
Notice of Allowance, dated Jul. 26, 2016, U.S. Appl. No. 14/325,307, filed Jul. 7, 2014.
Notice of Allowance, dated Aug. 16, 2016, U.S. Appl. No. 14/802,829, filed Jul. 17, 2015.
Non-Final Office Action, dated Sep. 15, 2016, U.S. Appl. No. 14/183,375, filed Feb. 18, 2014.
Non-Final Office Action, dated Sep. 30, 2016, U.S. Appl. No. 14/657,942, filed Mar. 13, 2015.
Final Office Action, dated Oct. 12, 2016, U.S. Appl. No. 14/741,423, filed Jun. 16, 2015.
Final Office Action, dated Oct. 17, 2016, U.S. Appl. No. 14/639,976, filed Mar. 5, 2015.
Non-Final Office Action, dated Oct. 26, 2016, U.S. Appl. No. 15/139,225, filed Apr. 26, 2016.
Advisory Action, dated Jan. 19, 2017, U.S. Appl. No. 14/639,976, filed Mar. 5, 2015.
Non-Final Office Action, dated Jan. 27, 2017, U.S. Appl. No. 14/198,473, filed Mar. 5, 2014.
Non-Final Office Action, dated Feb. 17, 2017, U.S. Appl. No. 14/833,038, filed Aug. 21, 2015.
Non-Final Office Action, dated Feb. 23, 2017, U.S. Appl. No. 15/246,094, filed Aug. 24, 2016.
Notice of Allowance, dated Mar. 1, 2017, U.S. Appl. No. 14/741,423, filed Jun. 16, 2015.
Non-Final Office Action, dated Mar. 22, 2017, U.S. Appl. No. 15/224,412, filed Jul. 29, 2016.
Non-Final Office Action, dated Mar. 30, 2017, U.S. Appl. No. 15/246,118, filed Aug. 24, 2016.
Non-Final Office Action, dated Mar. 31, 2017, U.S. Appl. No. 14/316,537, filed Jun. 26, 2014.
Notice of Allowance, dated Apr. 10, 2017, U.S. Appl. No. 14/639,976, filed Mar. 5, 2015.
Final Office Action, dated Apr. 13, 2017, U.S. Appl. No. 15/139,225, filed Apr. 26, 2016.
Final Office Action, dated May 11, 2017, U.S. Appl. No. 14/183,375, filed Feb. 18, 2014.
Non-Final Office Action, dated Jun. 7, 2017, U.S. Appl. No. 14/802,816, filed Jul. 17, 2015.
Final Office Action, dated Jun. 22, 2017, U.S. Appl. No. 14/657,942, filed Mar. 13, 2015.
Non-Final Office Action, dated Jul. 5, 2017, U.S. Appl. No. 14/848,202, dated Sep. 8, 2015.
Notice of Allowance, dated Jul. 31, 2017, U.S. Appl. No. 14/833,038, filed Aug. 21, 2015.
Final Office Action, dated Sep. 21, 2017, U.S. Appl. No. 15/246,118, filed Aug. 24, 2016.
Notice of Allowance, dated Sep. 29, 2017, U.S. Appl. No. 15/139,225, filedApr. 26, 2016.
Notice of Allowance, dated Oct. 10, 2017, U.S. Appl. No. 15/224,412, filed Jul. 29, 2016.
Final Office Action, dated Oct. 24, 2017, U.S. Appl. No. 14/316,537, filed Jun. 26, 2014.
"International Search Report" and "Written Opinion of the International Search Authority," dated Nov. 26, 2013 in Patent Cooperation Treaty Application No. PCT/US2013/047406, filed Jun. 24, 2013, 9 pages.
"International Search Report" and "Written Opinion of the International Search Authority," dated Aug. 9, 2013 in Patent Cooperation Treaty Application No. PCT/US2013/043436, filed May 30, 2013, 13 pages.
"International Search Report" and "Written Opinion of the International Search Authority," dated Jul. 1, 2014 in Patent Cooperation Treaty Application No. PCT/US2014/020880, filed Mar. 5, 2014, 14 pages.
"International Search Report" and "Written Opinion of the International Search Authority," dated Jun. 29, 2015 in Patent Cooperation Treaty Application No. PCT/US2015/012285, filed Jan. 21, 2015, 15 pages.
Hinman et al., U.S. Appl. No. 61/774,632, filed Mar. 7, 2013, 23 pages.
Office Action dated Jun. 15, 2015 in Chinese Design Patent Application 201530058063.8, filed Mar. 11, 2015, 1 page.
Notice of Allowance dated Sep. 8, 2015 in Chinese Design Patent Application 2015300580618, filed Mar. 11, 2015, 3 pages.

(56) References Cited

OTHER PUBLICATIONS

Weisstein, Eric, "Electric Polarization", Wolfram Reasearch [online], Retrieved from the Internet [retrieved Mar. 23, 2017] <URL:http://scienceworld.wolfram.com/physics/ElectricPolarization.html>, 2007, 1 page.
Liu, Lingjia et al., "Downlink MIMO in LTE-Advanced: SU-MIMO vs. MU-MIMO," IEEE Communications Magazine, Feb. 2012, pp. 140-147.
"International Search Report" and "Written Opinion of the International Searching Authority," Patent Cooperation Treaty Application No. PCT/US2017/012884, dated Apr. 6, 2017, 9 pages.
"Office Action," Chinese Patent Application No. 201580000078.6, dated Jul. 30, 2018, 5 pages [11 pages including translation].

* cited by examiner

ENCLOSURE FOR RADIO, PARABOLIC DISH ANTENNA, AND SIDE LOBE SHIELDS

CROSS REFERENCE TO RELATED APPLICATIONS

This application is a continuation of, and claims the benefit of, U.S. patent application Ser. No. 15/139,225, filed Apr. 26, 2016, entitled "Enclosure for Radio, Parabolic Dish Antenna, and Side Lobe Shields", now U.S. Pat. No. 9,871,302, issued on Jan. 16, 2018, which is a continuation of U.S. patent application Ser. No. 14/198,378, filed Mar. 5, 2014, entitled "Enclosure for Radio, Parabolic Dish Antenna, and Side Lobe Shields", now U.S. Pat. No. 9,362,629, issued Jun. 7, 2016, which claims the benefit of U.S. Provisional Patent Application Ser. No. 61/773,757, filed on Mar. 6, 2013, entitled "Enclosure for Radio, Parabolic Dish Antenna, and Side Lobe Shields". All of the aforementioned disclosures are hereby incorporated by reference herein in their entireties including all references cited therein.

FIELD OF THE INVENTION

The present technology is generally described as providing enclosures for a radio, parabolic dish antenna, and side lobe shields.

BACKGROUND

MIMO systems in general utilize multiple antennas at both the transmitter and receiver to improve communication performance. While not necessarily scaling linearly with antenna count, MIMO systems allow for the communication of different information on each of a plurality of antennas, generally using the same frequency, allowing a new dimension of scalability in high throughput communication. These MIMO systems exploit the use of spatial, polarization, time and/or frequency diversity to achieve orthogonality between multiple data streams transmitted simultaneously. Advanced downlink multi-user MIMO (MU-MIMO) systems takes advantage of the potential orthogonality between distinct receivers, allowing a single transmitter node to communicate with multiple receiver nodes simultaneously, sending unique data streams per receiver. Uplink MU-MIMO systems are also possible, whereby multiple nodes can simultaneously send unique streams to one or more other nodes. Exemplary systems that utilize MIMO technology include, but are not limited to, Wi-Fi networks, wireless Internet service providers (ISP), worldwide interoperability for microwave access (WiMAX) systems, and 4G long-term evolution (LTE) data transmission systems.

SUMMARY

In some embodiments, the present technology is directed to devices that comprise a parabolic circular reflector bounded by a side lobe shield that extends along a longitudinal axis of the dish antenna in a forward direction forming a front cavity, and a sidewall that extends along the longitudinal axis of the dish antenna in a rearward direction forming a rear cavity. In some instances, the dish antenna is combined with a radio that transmits and/or receives signals.

In other embodiments the present technology is directed to dish antenna consisting of: a parabolic circular reflector bounded by a side lobe shield that extends along a longitudinal axis of the dish antenna in a forward direction forming a front cavity, and a sidewall that extends along the longitudinal axis of the dish antenna in a rearward direction forming a rear cavity, all manufactured as a monolithic structure.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive is omitted. It will be understood that the technology is not necessarily limited to the particular embodiments illustrated herein.

DESCRIPTION OF EXEMPLARY EMBODIMENTS

Figure 1A:
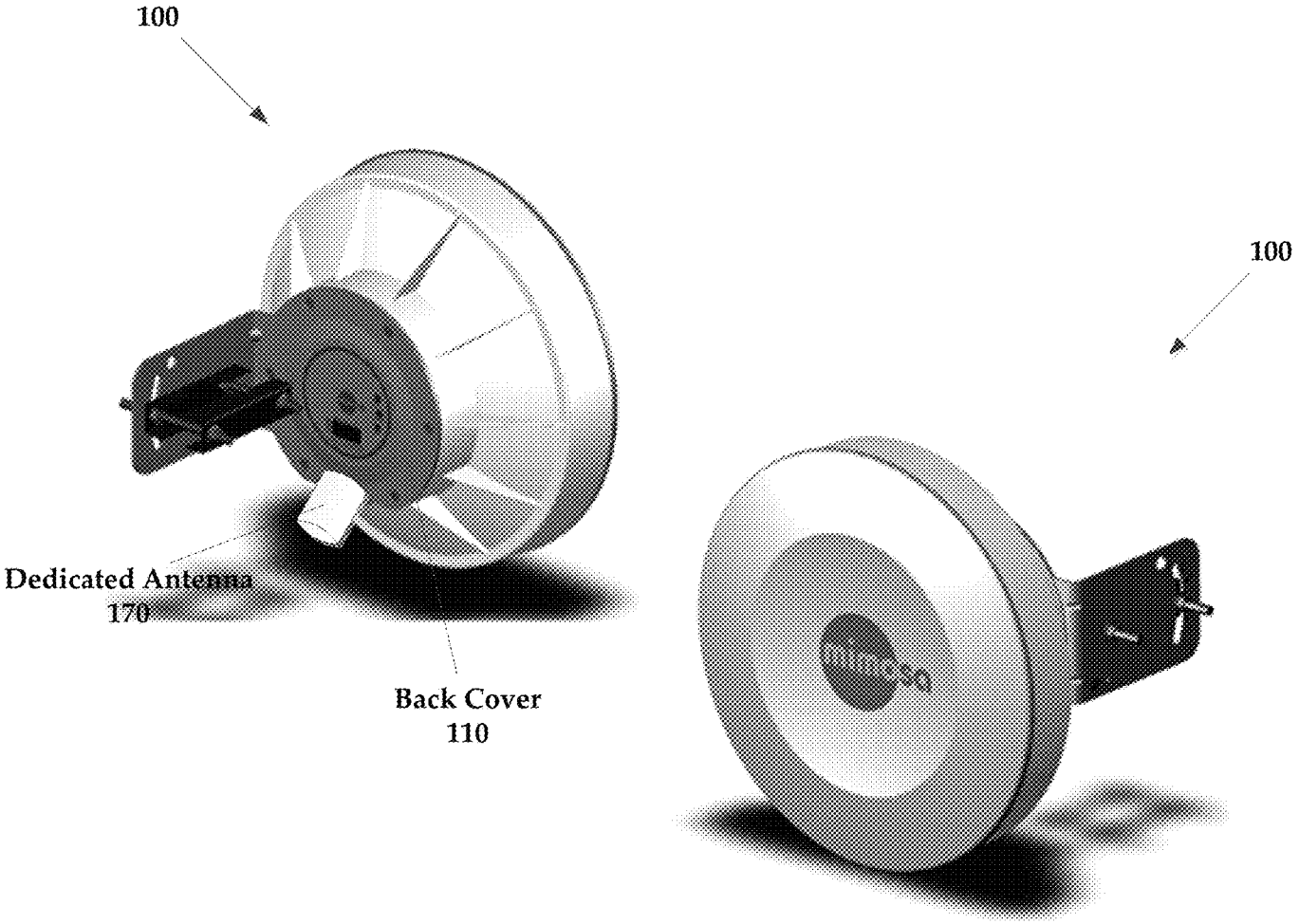
FIG. 1A are front and rear perspective views of an exemplary enclosure.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, is identified throughout the drawings with like reference characters. It will be further understood that several of the figures are merely schematic representations of the present technology. As such, some of the components may have been distorted from their actual scale for pictorial clarity.

According to some embodiments, the present technology comprises a single piece of molded plastic which can house electronics for a radio, serve as a parabolic antenna when metalized, and provide rejection of radiation from adjacent antennas by forming a cylindrical metalized surface beyond the parabolic dish (e.g., side lobe shield). Devices of the present technology can be utilized in noisy environments, for example, a tower having multiple transmitters and receivers that are disposed proximately to one another. Devices of the present technology can be utilized to effectively transmit and/or receive signals in these noisy environments in such a way that interference is reduced. These devices are be configured to reduce deleterious transmission and receipt of side lobe radiation from adjacent radiation generating devices, and enhance signal pickup. These and other advantages of the present technology will be described in greater detail herein.

Figure 1B:
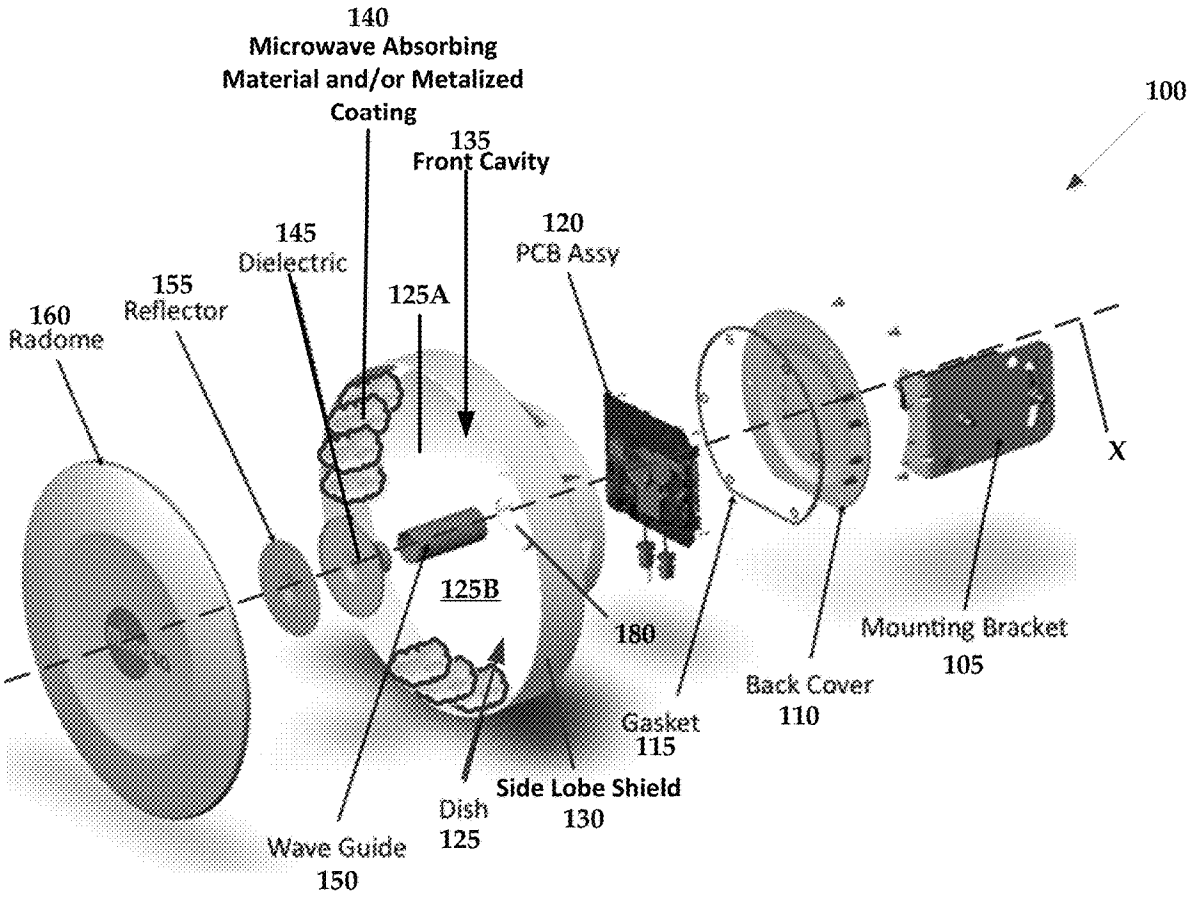
FIG. 1B is an exploded perspective view of the exemplary enclosure of FIG. 1A.
Figure 1C:
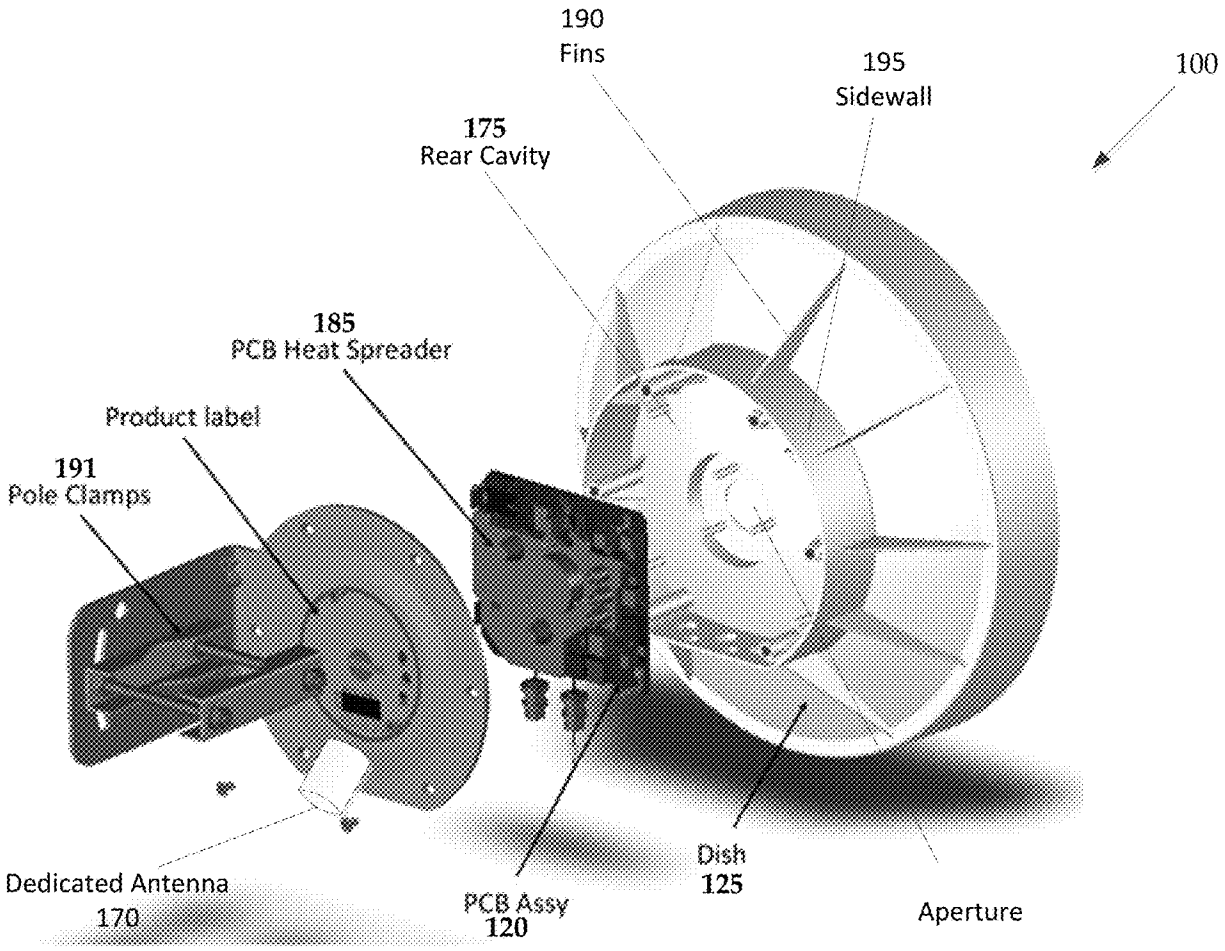
FIG. 1C is an exploded perspective view of the exemplary enclosure of FIGS. 1A-B, shown from the rear.

FIGS. 1A-C collectively illustrate an exemplary device 100. FIG. 1A includes front and rear perspective views of a device 100 in an assembled configuration. The device 100 is provided with a dedicated antenna 170 that extends from a back cover 110 of the device 100.

FIG. 1B is an exploded perspective view of the device 100. Generally, the device 100 comprises a mounting bracket 105, a back cover 110, a gasket 115, a PCB (printed circuit board) assembly 120, a dish 125, a dielectric plate 145, a reflector 155, and a radome 160.

It will be understood that advantageously, the dish of the present technology is manufactured monolithically as one piece. That is, the dish 125 includes a parabolic circular reflector 125A that is bounded by the side lobe shield 130 to form the front cavity 135, and rear cavity 175. All these components are manufactured as a single device, as opposed to technologies where dishes are formed from separate components that are assembled in the field. Further, many dishes are an amalgamation of parts from a plurality of manufacturers, which can lead to physical incompatibility and on the fly modification in the field.

Advantageously, the monolithic dish provides advantages such as reduced manufacturing cost, since the dish can be manufactured in a single process. For example, the dish can be manufactured using injection molding, or any other similar process that is capable of producing a dish with the physical features as those illustrated in the drawings of the disclosure.

Another advantage of the monolithic structure is that it allows for storage and incorporation of necessary electronics for the antenna within the dish. For example, the PCB assembly 120 can be housed within the rear cavity 175. This places the PCB assembly 120 and waveguide 150 (discussed in greater detail below) in very close proximity to the parabolic circular reflector 125A, which reduces or eliminates signal attenuation of signals produced by the PCB assembly 120 that are directed through the waveguide 150 that would be present if the PCB assembly 120 and/or waveguide are not located proximate the parabolic circular reflector 125A.

The mounting bracket 105 that allows the device 100 to be pivotally coupled to a mounting surface, such as a tower (not shown). The ability of the device 100 to be pivotally connected to a mounting surface allows for an azimuth angle to be established, as would be known to one of ordinary skill in the art with the present disclosure before them. While the mounting bracket 105 has been described, the device 100 couples with a structure using any one or more of a number of mechanisms that would be apparent to one of ordinary skill in the art with the present disclosure before them. The mounting bracket 105 couples with a back cover via a plurality of fasteners. The mounting bracket 105 couples to the back cover 110 using fasteners.

In some embodiments, the mounting bracket 105 couples with a set of pole clamps 191 that allow the device 100 to be clamped to a pole or other similar structure.

The device 100 also comprises a dish antenna 125 that is formed so as to include a rear cavity 175 (see FIG. 1C) and a front cavity 135. A PCB assembly 120 is disposed at least partially within the rear cavity of the dish. The PCB assembly 120 includes any circuits needed to operate the device 100. In some embodiments, the dish antenna 125 is a parabolic circular reflector 125A that is bounded by the side lobe shield 130 to form the front cavity 135. The front cavity extends forwardly from the dish.

The shape of the parabolic reflector depends upon the desired radiation pattern for the device 100. Thus, the exact shape and size of the parabolic circular reflector varies according to design and implementational requirements.

A seal, such as a gasket 115, is disposed between the outer peripheral edge of the rear cavity 175 and the back cover 110 to sealingly protect the PCB assembly 120 from contamination. The PCB assembly 120 also includes a PCB heat spreader 185 or other means for transferring heat generated by the PCB assembly 120 to the ambient environment such as fans and so forth.

In some instances, the dish 125 includes a side lobe shield 130 that extends beyond the outer peripheral edge of the dish 125. In some instances the side lobe shield 130 is a shroud having a sidewall that forms a ring around the outer peripheral edge of an upper surface of the dish 125. The side lobe shield 130 extends from the dish 125 axially along a longitudinal axis X of the device 100.

The dish 125, in some embodiments, is manufactured as a monolithic or one piece device. The dish 125 is manufactured from any one or combination of materials that are suitable for use as with an antenna.

Advantageously, the inner surface of the side lobe shield 130 is provided with a metalized coating. The upper surface 125B of the parabolic reflector 125A also includes a metalized coating. In some instances at least a portion of the inner surface of the side lobe shield is augmented with a metallic coating and/or a microwave absorbing material 140, such as a foam or other electrically insulating material that is coated along the inner surface of the front cavity 135 of the dish 125. For example, the metallic coating and/or a microwave absorbing material 140 lines the inner portion of the side lobe shield 130.

The upper surface 125B is generally circular and parabolic in shape, which aids in directing radiation along the longitudinal axis X. Again, the shape of the dish 125 functions to reduce emissions of side lobe radiation. In some embodiments, the dish 125 has an annular shaped mounting ring 180 that is configured to receive the wave guide 150.

The microwave absorbing material 140 is shown as being disposed within the front cavity 135 in FIG. 1B, but can also be applied or sprayed to the inner surface of the side lobe shield 130. In other instances, the microwave absorbing material 140 is integrated into the side lobe shield 130 itself. That is, the side lobe shield 130 is manufactured as a layered or composite. For example, the side lobe shield 130 comprises a substrate of a metallic material that has a layer of microwave absorbing material applied thereto. Specifically, the absorbing material would be applied to a surface of the side lobe shield that is proximate the wave guide 150 of the device.

In other embodiments, a metalized coating is applied to the entire upper surface of the dish 125 and the inner sidewall of the side lobe shield 130.

Because the side lobe shield 130 extends beyond the outer peripheral edge of the dish 125, the side lobe shield 130 functions to direct the signals reflected by the dish surface in a more uniform and directed pattern. For example, the side lobe shield 130 reduces side lobe radiation which is transmitted from and/or received by the device 100. Thus, the device 100 reduces an amount of signals (e.g., radiation) which are received by the device 100 such as those transmitted by adjacent transmitters. Also, the side lobe shield 130 of the device 100 also reduces an amount of microwave signals transmitted via side lobe projection by the device 100. Thus, the device 100 reduces both the transmission and reception of deleterious side lobe signals.

The device 100 also comprises a wave guide 150 that is communicatively coupled with the PCB assembly 120. A cylindrical dielectric plate 145 couples with the wave guide 150. Also, a reflector 155 is associated with the dielectric plate 145. The combination of the PCB assembly 120, wave guide 150, dielectric plate 145, and reflector 155 are collectively referred to as a "radio." A radome 160 attaches to the side lobe shield 130 to sealingly cover the reflector 155, dielectric plate 145, and wave guide 150 that are housed within the front cavity 135.

It will be understood that the radome 160, side lobe shield 130, dish 125, and back cover 110 of the device 100 is constructed from any suitable material such as a plastic, a polymeric material, a resin, a composite material, a natural material, or any other material that would be known to one of ordinary skill in the art.

According to some embodiments, the dish 125 and the side lobe shield 130 is manufactured as an integral unit. Moreover, the rear cavity 175 of the dish 125 is formed to provide a mounting surface for receiving the PCB assembly 120. The rear cavity 175 is formed by a sidewall 195 that extends rearwards from the dish antenna 125 along the longitudinal axis X. The sidewall 195 extends in an opposing direction from the side lobe shield 130.

The dish 125, as an integral unit, is manufactured from a plastic material, a polymeric material, a resin, a composite material, or other suitable material that would be known to one of ordinary skill in the art with the present disclosure before them. As mentioned before, the inner sidewall of the side lobe shield 130 and the upper surface 125B of the dish 125 are metalized while the rear cavity 175 is not metalized. Additionally, the side lobe shield 130 is provided with a microwave insulating material.

According to some embodiments, the dish antenna 125 comprises a series of fins 190. These fins 190 may extend from the rear cavity 175 upwardly to the edge of the side lobe shield 130. More specifically, the series of fins extends upwardly from the sidewall of the rear cavity along an underside of the parabolic circular reflector or dish 125.

Figure 2:
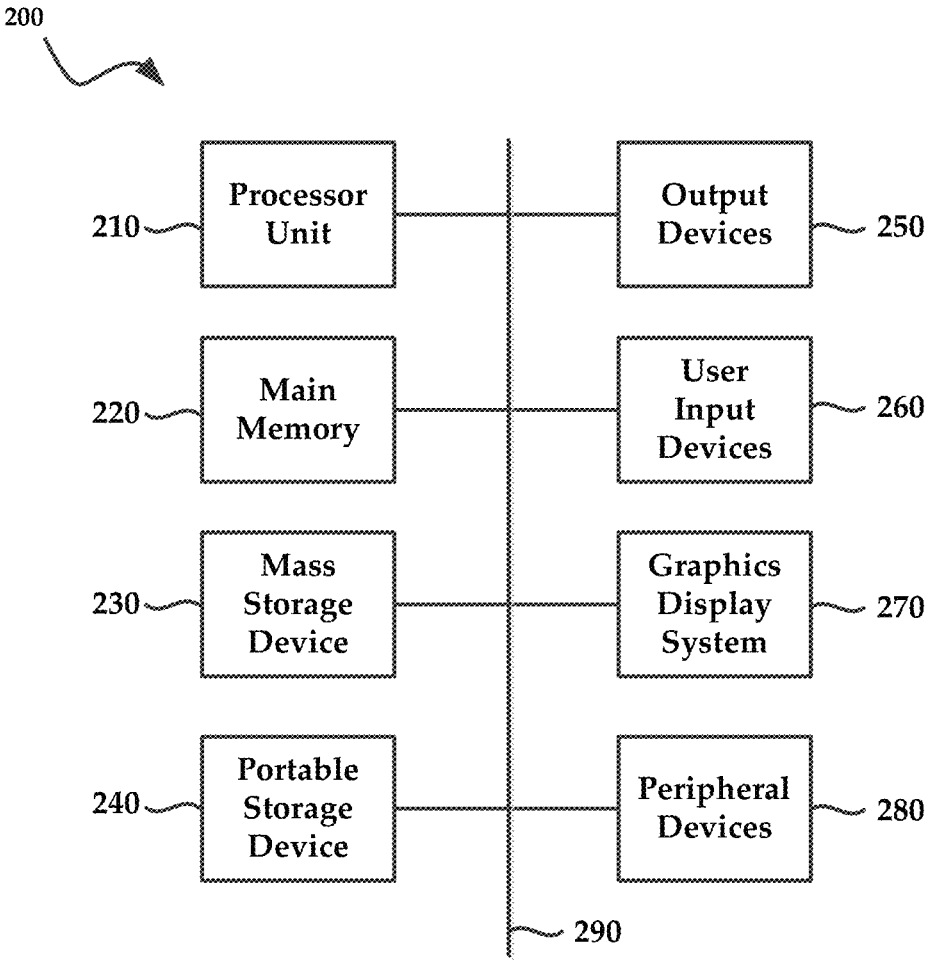
FIG. 2 illustrates an exemplary computing device that is used to implement embodiments according to the present technology.

FIG. 2 illustrates an exemplary computing device 200 (also referenced as system 200) that is used to implement an embodiment of the present technology. The computing device 200 of FIG. 2 includes one or more processors 210 and memory 220. The computing device 200 is utilized to control one or more functions via the PCB assembly of device 100 of FIG. 1. In some instances, the processor 210 and memory 220 is integrated into the PCB assembly 120. Exemplary functions executed by the processor 210 and stored in memory 220 includes, but are not limited to transmission and/or receipt of signals, as well as signal processing commonly utilized with 2×2 (or greater) multiple input, multiple output (MIMO) transceivers.

The Main memory 220 stores, in part, instructions and data for execution by processor 210. Main memory 220 can store the executable code when the system 200 is in operation. The system 200 of FIG. 2 further includes a mass storage device 230, portable storage medium drive(s) 240, output devices 250, user input devices 260, a graphics display 270, and other peripheral devices 280.

The components shown in FIG. 2 are depicted as being connected via a single bus 290. The components are connected through one or more data transport means. Processor unit 210 and main memory 220 is connected via a local microprocessor bus, and the mass storage device 230, peripheral device(s) 280, portable storage device 240, and graphics display 270 is connected via one or more input/output (I/O) buses.

Mass storage device 230, which is implemented with a magnetic disk drive, an optical disk drive, and/or a solid-state drive is a non-volatile storage device for storing data and instructions for use by processor unit 210. Mass storage device 230 can store the system software for implementing embodiments of the present technology for purposes of loading that software into main memory 220.

Portable storage device 240 operates in conjunction with a portable non-volatile storage medium, such as a floppy disk, compact disk or digital video disc, to input and output data and code to and from the computing device 200 of FIG. 2. The system software for implementing embodiments of the present technology is stored on such a portable medium and input to the computing device 200 via the portable storage device 240.

Input devices 260 provide a portion of a user interface. Input devices 260 includes an alphanumeric keypad, such as a keyboard, for inputting alphanumeric and other information, or a pointing device, such as a mouse, a trackball, stylus, or cursor direction keys. Additionally, the system 200 as shown in FIG. 2 includes output devices 250. Suitable output devices include speakers, printers, network interfaces, and monitors.

Graphics display 270 includes a liquid crystal display (LCD) or other suitable display device. Graphics display 270 receives textual and graphical information, and processes the information for output to the display device.

Peripheral 280 includes any type of computer support device to add additional functionality to the computing device. Peripheral device(s) 280 includes a modem or a router.

The components contained in the computing device 200 of FIG. 2 are those typically found in computing devices that is suitable for use with embodiments of the present technology and are intended to represent a broad category of such computer components that are well known in the art. Thus, the computing device 200 of FIG. 2 can be a personal computer, hand held computing device, telephone, mobile computing device, workstation, server, minicomputer, mainframe computer, or any other computing device. The computer can also include different bus configurations, networked platforms, multi-processor platforms, etc. Various operating systems can be used including UNIX, Linux, Windows, Macintosh OS, Palm OS, and other suitable operating systems.

Some of the above-described functions are composed of instructions that are stored on storage media (e.g., computer-readable medium). The instructions is retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

It is noteworthy that any hardware platform suitable for performing the processing described herein is suitable for use with the systems and methods provided herein. Computer-readable storage media refer to any medium or media that participate in providing instructions to a central processing unit (CPU), a processor, a microcontroller, or the like. Such media may take forms including, but not limited to, non-volatile and volatile media such as optical or magnetic disks and dynamic memory, respectively. Common forms of computer-readable storage media include a floppy disk, a flexible disk, a hard disk, magnetic tape, any other magnetic storage medium, a CD-ROM disk, digital video disk (DVD), any other optical storage medium, RAM, PROM, EPROM, a FLASHEPROM, any other memory chip or cartridge.

Computer program code for carrying out operations for aspects of the present invention is written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer is coupled with the user's computer through any type of network, including a local area network (LAN) or a wide area network (WAN), or the connection is made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions is provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as is included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A dish antenna, comprising:

a parabolic circular reflector bounded by a side lobe shield that extends along a longitudinal axis of the dish antenna in a forward direction forming a front cavity, the side lobe shield being configured to reduce transmission of side lobe radiation, as well as reduce receipt of side lobe radiation emitted by adjacent radiation generating devices; and a sidewall that extends along the longitudinal axis of the dish antenna in a rearward direction forming a rear cavity.

2. The dish antenna according to claim 1, wherein the dish antenna is manufactured as a monolithic structure.

3. The dish antenna according to claim 1, further comprising a radio associated with the dish antenna.

4. The dish antenna according to claim 1, further comprising a printed circuit board assembly that generates signals that are directed through a wave guide that is disposed in a center of the dish antenna, wherein the printed circuit board assembly is disposed in the rear cavity in such a way that the printed circuit board assembly and the wave guide are placed in close proximity to the parabolic circular reflector.

5. The dish antenna according to claim 4, wherein the parabolic circular reflector includes an annular mounting ring and the wave guide is received within the annular mounting ring.

6. The dish antenna according to claim 5, wherein the wave guide is tubular and extends along the longitudinal axis of the dish.

7. The dish antenna according to claim 6, further comprising a circular dielectric plate configured to mate with the wave guide in such a way that the dielectric plate is spaced apart from an upper surface of the dish antenna.

8. The dish antenna according to claim 7, further comprising a reflector dish that is disposed on top of the dielectric plate.

9. The dish antenna according to claim 8, further comprising a radome cover that encloses the reflector dish, dielectric plate, and wave guide within a front cavity of the dish antenna formed by the upper surface of the dish antenna and the side lobe shield, wherein the radome cover mates with the side lobe shield.

10. The dish antenna according to claim 1, wherein the dish antenna comprises the rear cavity that receives a printed circuit board assembly, the printed circuit board assembly comprising the radio.

11. The dish antenna according to claim 10, further comprising a back cover that encloses the printed circuit board assembly within the rear cavity.

12. The dish antenna according to claim 11, further comprising a heat spreader that is coupled to the printed circuit board assembly.

13. The dish antenna according to claim 1, wherein the front cavity is provided with a metallic coating.

14. The dish antenna according to claim 1, further comprising a microwave absorbing material that coats an inner surface of the side lobe shield.

15. The dish antenna according to claim 1, further comprising a series of fins that extend upwardly from the sidewall of the rear cavity along an underside of the parabolic circular reflector.

16. A dish antenna, consisting of:

a parabolic circular reflector bounded by a side lobe shield that extends along a longitudinal axis of the dish antenna in a forward direction forming a front cavity, the side lobe shield being configured to reduce transmission of side lobe radiation, as well as reduce receipt of side lobe radiation emitted by adjacent radiation generating devices; and a sidewall that extends along the longitudinal axis of the dish antenna in a rearward direction forming a rear cavity, all manufactured as a monolithic structure.

* * * * *